US007024816B1

(12) United States Patent
Marks et al.

(10) Patent No.: US 7,024,816 B1
(45) Date of Patent: Apr. 11, 2006

(54) CONTAINER HANGER

(76) Inventors: Stephen Rickert Marks, P.O. Box 6258, Syracuse, NY (US) 13217; Sona Bejdova, P.O. Box 6258, Syracuse, NY (US) 13217

( * ) Notice: Subject to any disclaimer, the term of this patent is extended or adjusted under 35 U.S.C. 154(b) by 0 days.

(21) Appl. No.: 11/060,826

(22) Filed: Feb. 18, 2005

(51) Int. Cl.
*A47G 7/00* (2006.01)
*A01G 9/02* (2006.01)

(52) U.S. Cl. ..... 47/39; 47/66.6

(58) Field of Classification Search ..... 47/39, 47/41.01, 47, 66.7, 67, 82, 83, 87; 248/291.1, 248/153, 313, 315; D8/1; D11/164; D6/556
See application file for complete search history.

(56) References Cited

U.S. PATENT DOCUMENTS

| | | | | | |
|---|---|---|---|---|---|
| 750,063 | A | * | 1/1904 | Redding | 211/74 |
| 1,343,363 | A | * | 6/1920 | Hall | 211/74 |
| 1,603,641 | A | * | 10/1926 | Richards | 248/291.1 |
| 1,676,468 | A | * | 7/1928 | Waterman | 47/47 |
| 1,833,690 | A | * | 11/1931 | Penners | 248/210 |
| 2,136,279 | A | * | 11/1938 | De Vilbiss | 248/153 |
| 2,764,384 | A | * | 9/1956 | Kirsch | 248/305 |
| 3,001,753 | A | * | 9/1961 | Smith | 248/313 |
| 3,310,270 | A | * | 3/1967 | Ciancio | 248/210 |
| 3,324,591 | A | * | 6/1967 | Bergstein | 47/78 |
| 3,490,726 | A | * | 1/1970 | Mills | 248/313 |
| D230,884 | S | * | 3/1974 | Johnson | D25/100 |
| D255,635 | S | * | 7/1980 | Valmassei | D7/620 |
| D266,382 | S | * | 10/1982 | Hutchinson | D6/556 |
| 5,118,059 | A | * | 6/1992 | Mainer | 248/215 |
| D348,631 | S | * | 7/1994 | Hollinger | D8/373 |
| 5,390,443 | A | | 2/1995 | Emalfarb et al. | |
| 5,457,911 | A | | 10/1995 | Vollink | |
| 5,487,517 | A | * | 1/1996 | Smith | 248/215 |
| 5,586,413 | A | * | 12/1996 | Sharon | 47/67 |
| 5,823,360 | A | | 10/1998 | Gorosave | |
| 6,202,964 | B1 | * | 3/2001 | Thornhill | 248/219.4 |
| D496,200 | S | * | 9/2004 | Jackson et al. | D6/513 |

* cited by examiner

*Primary Examiner*—Francis T. Palo
(74) *Attorney, Agent, or Firm*—Luedeka, Neely & Graham, P.C.

(57) ABSTRACT

An improved plant container hanger for suspension from a support rail, such as a chain link fence, wherein the device may be partially inserted into the fence links to stabilize the container and position a plant container carried thereby in a stable, substantially horizontal, position.

3 Claims, 2 Drawing Sheets

CONTAINER HANGER

FIELD OF THE INVENTION

This invention relates in general to a device for holding and displaying containers in which plants, vegetables, flowers or the like are planted and, in particular, to such a plant container holder which is especially suitable to be supported by or suspended from a support structure such as a chain link fence. In a preferred embodiment of the device, a container is suspended from the support rail of a chain link fence, and the device is partially inserted into the fence links to stabilize the container and position the container carried thereby in a stable, substantially horizontal, position.

BACKGROUND OF THE INVENTION

Various support devices or hanger assemblies have been developed whereby a container for a potted plant may be suspended from a longitudinally extending horizontal rail, such as a porch or deck rail. Such devices generally include a hook portion which engages the support rail to support or suspend the device from the rail, and a container support portion which functions to engage a container so that the container will be secured to the device.

In such existing devices, the stability of the support device or hanger assembly generally relies upon the weight of the container, and its contents, to stabilize the device relative to its supporting rail. It would be very desirable for plant support devices or hanger assemblies to have an increased stabilization of the supporting structure relative to the rail from which the device is suspended. In this manner, larger containers could be utilized, which would increase the loading force exerted on the supporting rail, but which could accommodate additional potting material and consequently larger and more productive plants.

However, an increase in the weight of the container and its contents would result in the pivoting of a container and the plant carried within the container about the supporting rail because of any offset between that portion of the supporting structure which is coupled to the supporting rail and that portion of the device which engages and supports the container. Such pivoting of the support device, or hanger assembly, about its point of contact with the supporting rail creates a decided tilt in the orientation of the container. Such a tilt creates a problem in watering the plants contained in the container and in retaining liquid, such as liquid fertilizer, therein. Because of the tilt of the container about the supporting rail it would be difficult to provide an adequate amount of moisture to the container and plant(s) contained therein.

SUMMARY OF THE INVENTION

The present invention is directed to overcoming one or more of the problems or disadvantages associated with the art to which the invention pertains, as will be more readily understood and fully appreciated from the following detailed description of a preferred embodiment of the present invention.

DESCRIPTION OF THE DRAWINGS

Further objectives of the invention, together with additional features contributing thereto and advantages accruing therefrom, will be apparent from the following description of a preferred embodiment of the invention which is shown in the accompanying drawings, wherein.

DETAILED DESCRIPTION OF THE PREFERRED EMBODIMENTS

Figure 1:
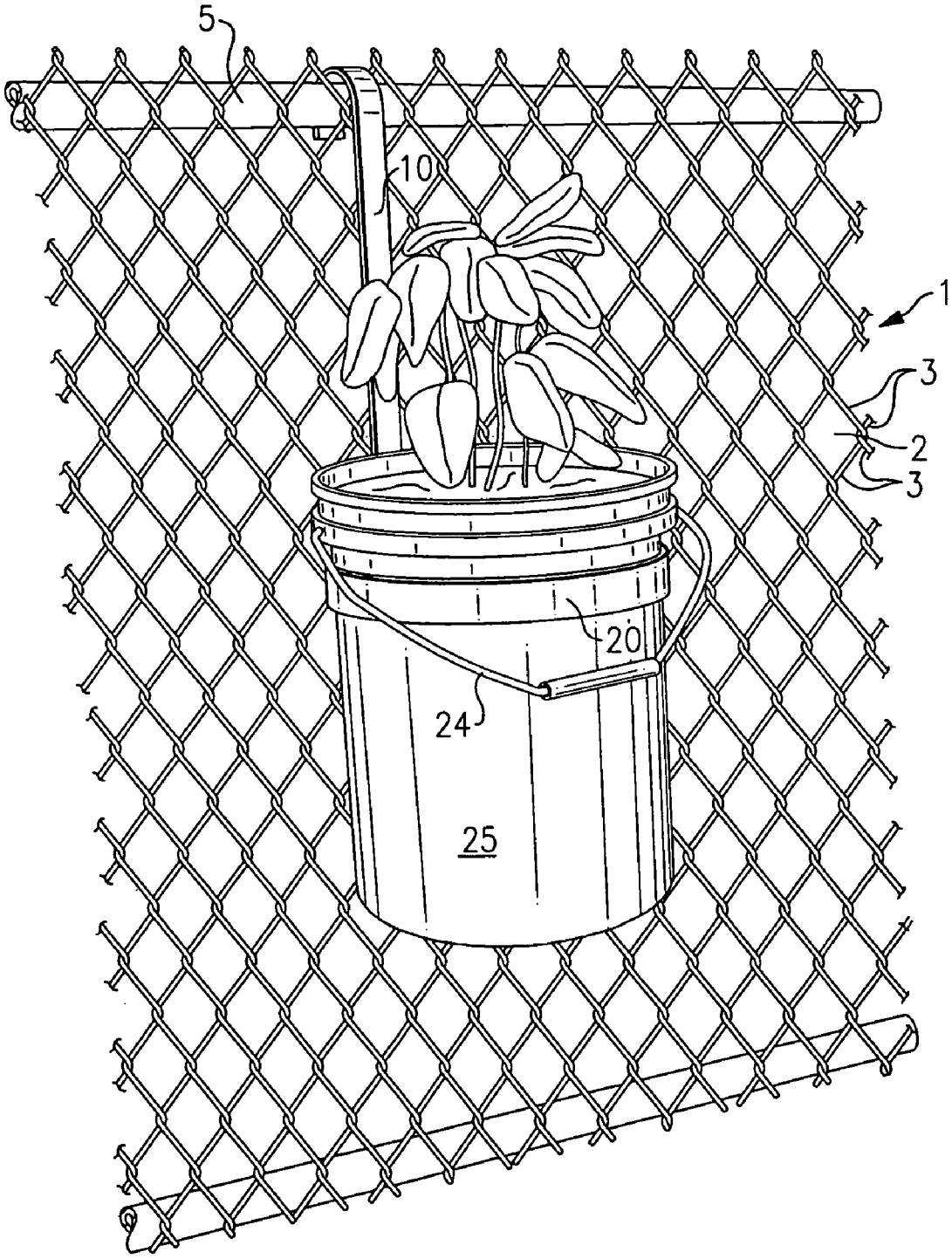
FIG. 1 is a perspective view of our invention in an application environment.
Figure 2:
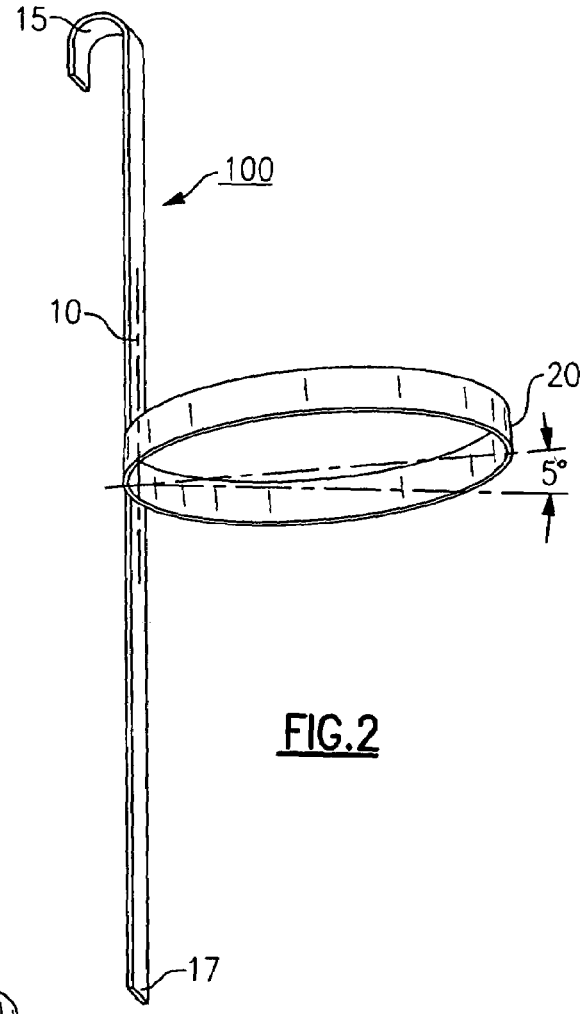
FIG. 2 is a perspective view of our invention to better illustrate the manner in which a portion of our invention is inserted between the links of the fence to stabilize the container supported thereon.
Figure 3:
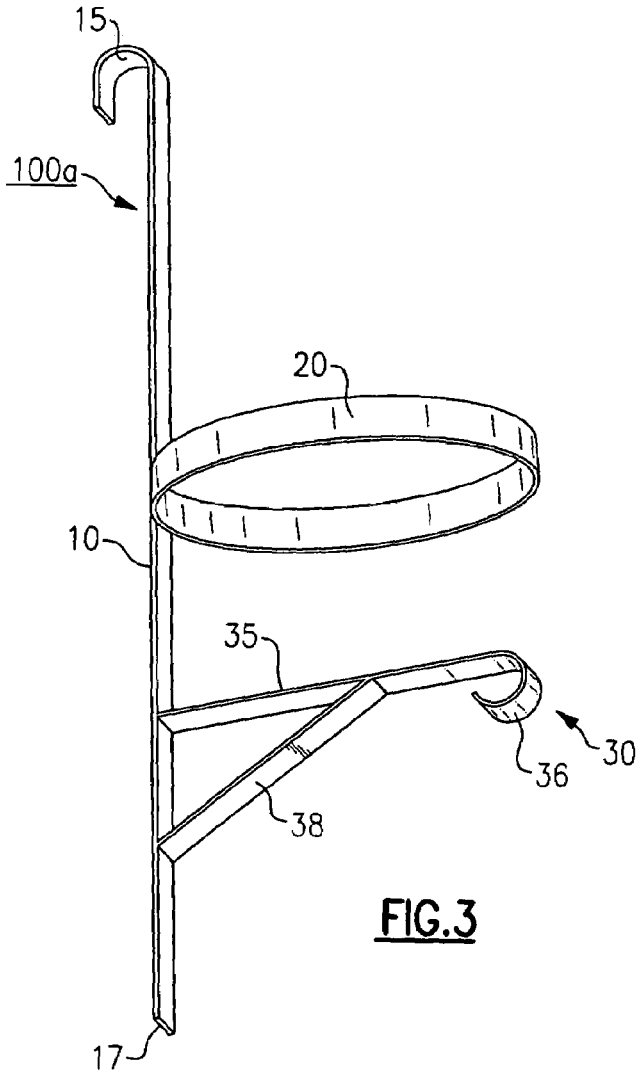
FIG. 3 is a perspective view of a second embodiment of our invention incorporating another form of container support.

Referring now to the drawings, there is illustrated a first embodiment of our invention in FIGS. 1 and 2, and a second or modified embodiment of our invention in FIG. 3. For convenience of illustration, like parts are identified by the same reference numerals.

As best illustrated in FIG. 1, our plant container hanger 100 includes an elongated support bar 10 comprising a straight length of a rigid material, such as 3/16" steel although a plastic material of suitable strength may be used so long as the material would be sufficient to support a predetermined size container, potting material and growing plants. One end of the support bar 10 is formed with a hook portion 15, formed at one end, with the opposed end terminating in a straight or tapered guide portion 17.

The curve of the hook portion 15 of the support bar 10 is sufficient to partially enclose a support rail from which the plant container hanger 100 is to be suspended, which in the preferred embodiment illustrated in FIG. 1 is a top rail 5 of a conventional chain-link fence 1. The opposed guide portion end 17 of the support bar 10 is sized to pass through diamond-shaped openings 2 of the chain-link fence 1, which are formed by intersecting fence wires 3 which create such a pattern. In this manner, the support bar 10 is supported by the hook portion 15 from the support rail 5 and stabilized by the guide portion 17 engaging the openings 2 formed in the fence 1.

While the preferred embodiment illustrated in FIGS. 1 and 2 is used with a chain-link fence 1, other support rails may be utilized for engaging the hook portion 15 to suspend the plant container hanger 10 such as a porch rail or the like, as well as other forms of stabilization for the free end 17 may be used, such as spaced wooden slats or the like.

Positioned approximately midway along the support bar 10 is a plant retaining collar 20, which is secured to the support bar 10 for receiving and supporting therein a plant container 25. The collar 20 is sized a predetermined diameter based upon the size of the plant container 25 which is to be received therein. For purposes of illustration, the preferred embodiment of the collar 20 which is illustrated in FIGS. 1 and 2 is formed from 3/16" steel in a diameter of approximately 11½" for use with a conventional 5 gallon container in which plants, such as vegetables, may be planted and grown.

As best illustrated in FIG. 2, the collar 20 is secured to the support bar 10 at an angle such that the collar 20 extends outwardly and upwardly there from at an angle of approximately 5 degrees above the horizontal. In this manner when the hook portion 15 of the support bar 10 is positioned about the rail 5, and the free end 17 forming the guide portion is positioned through the diamond-shaped openings 2 of the chain-link fence 1, when the full plant container 25 is placed in the collar 20 the weight thereof will rotate the support bar

10 about the rail 5 a limited amount, and the slight angle at which the collar 20 is joined to the support bar 10 will result in the container 25 being carried in a substantially horizontal position.

In addition to the collar 20, the plant container hanger 10 can be constructed to incorporate a different type of container support. As best illustrated in FIG. 3, the plant container hanger 100*a* utilizes a suspension type hanger 30 wherein a substantially horizontal container support bar 35 is formed with a hook portion 36, to which a carrying handle 24 of a plant container 25 can be attached to suspend the container 25 from the suspension hanger 30. To provide additional support for the container support bar 35, an angle support 38 is secured between the support bar 10 and the horizontal container support bar 35. Such suspension type hangers 30 can be used alone on the support bar 10 or in combination with the container receiving collar 20.

While this invention has been described in the specification and illustrated in the drawings with reference to preferred embodiments, the structures of which have been disclosed herein, it will be understood by those skilled in the art to which this invention pertains that various changes may be made and equivalents may be substituted for elements of the invention without departing from the scope of the claims. This application was prepared without reference to any particular dictionary. Accordingly, the definition of the terms used herein conforms to the meaning intended by the inventors acting as their own lexicographer, in accordance with the teaching of the application, rather that any dictionary meaning which is contrary to or different from the inventors' meaning regardless of the authoritativeness of such dictionary.

Therefore, it is intended that the invention not be limited to the particular embodiments described in the specification and shown in the drawings as the best mode presently known by the inventors for carrying out this invention, nor confined to the details set forth, but that the invention will include all embodiments, modifications and changes as may come within the scope of the following claims.

What is claimed is:

1. A plant container hanger for supporting a plant container in a stable substantially horizontal position, comprising:

an elongated support bar having a first end curved to form a hook portion for engaging a support rail from which said elongated support bar is to be suspended;

container support means secured to said elongated support bar at a position below said hook portion for receiving and supporting a container therefrom;

said container support means comprising a closed loop;

said closed loop being inclined upwardly toward said first end of said elongated support bar at an angle of approximately 5 degrees;

said container support means extending outwardly from said elongated support bar and inclined upwardly towards said first end thereof; and a suspension hanger comprising a substantially horizontal container support bar having a hook portion adapted to receive a carrying handle of a plant container;

said suspension hanger including an angle support extending between said elongated support bar and said container support bar.

2. A plant container hanger for supporting a plant container in a stable substantially horizontal position as defined by claim 1 wherein said elongated support bar has a second end terminating in a guide portion adapted to be engaged to stabilize said plant container hanger when a plant container is placed in said container support means.

3. A plant container hanger for supporting a plant container in a stable substantially horizontal position as defined by claim 2 wherein said hook portion is adapted to engages a support rail of a chain-link fence and said guide portion is adapted to be inserted into a diamond pattern of the chain-link fence.

* * * * *